United States Patent [19]

Dyer et al.

[11] Patent Number: 4,897,691

[45] Date of Patent: Jan. 30, 1990

[54] APPARATUS FOR DRYING AND FUSING A LIQUID IMAGE TO A COPY SHEET

[75] Inventors: Dexter A. Dyer, Williamson; Thomas F. Szlucha, Fairport, both of N.Y.

[73] Assignee: Xerox Corporation, Stamford, Conn.

[21] Appl. No.: 858,152

[22] Filed: May 1, 1986

[51] Int. Cl.[4] ..... G03G 15/20

[52] U.S. Cl. ..... 355/288; 355/290; 219/216

[58] Field of Search ..... 355/3 FU, 14 FU, 10; 219/216, 388; 432/60; 430/99, 124; 34/4, 41

[56] References Cited

U.S. PATENT DOCUMENTS

| | | | |
|---|---|---|---|
| 3,079,483 | 2/1963 | Godichini et al. . | |
| 3,465,203 | 9/1969 | Galster et al. | 315/173 |
| 3,566,076 | 2/1971 | Fantuzzo | 219/216 |
| 3,679,302 | 7/1972 | Ludwig | 355/3 FU |
| 3,854,224 | 12/1974 | Yamaji et al. | 34/77 |
| 3,857,189 | 12/1974 | Katayama | 34/41 X |
| 4,137,340 | 1/1979 | Verlinden et al. | 427/16 |
| 4,147,922 | 4/1979 | Naeser et al. | 219/216 |
| 4,423,956 | 1/1984 | Gordon | 355/110 |
| 4,435,072 | 3/1984 | Adachi | 355/3 FU |
| 4,439,462 | 3/1984 | Tarumi et al. | 430/99 X |
| 4,527,509 | 7/1985 | Richardson | 118/60 X |
| 4,531,824 | 7/1985 | Landa | 355/3 FU |
| 4,639,405 | 1/1987 | Franke | 355/3 FU |

FOREIGN PATENT DOCUMENTS

| | | |
|---|---|---|
| 55-108677 | 8/1980 | Japan . |
| 55-133075 | 10/1980 | Japan . |
| 59-121365 | 7/1984 | Japan . |
| 2079222 | 1/1982 | United Kingdom . |

OTHER PUBLICATIONS

Japanese Patent Abstracts, vol. 10, No. 2 (P-96) (880), Jan. 8, '82, Publication 56-12879, Fixing Device.

Japanese Patent Abstracts, vol. 10, No. 169 (P-468) (2225), Jun. '86, Publication 61-20075, Flash Fixing Device.

*Primary Examiner*—R. L. Moses

*Attorney, Agent, or Firm*—H. Fleischer; J. E. Beck; R. Zibelli

[57] ABSTRACT

A reproducing machine in which an electrostatic latent image recorded on a photoconductive member is developed with a liquid developer material comprising at least a liquid carrier having pigmented particles dispersed therein. The developed image is transferred from the photoconductive member to a sheet of support material. The sheet of support material having the developed image thereon is dried to remove substantially all of the liquid carrier transferred thereto. The pigmented particles are permanently fused to the sheet of support material in image configuration.

5 Claims, 2 Drawing Sheets

APPARATUS FOR DRYING AND FUSING A LIQUID IMAGE TO A COPY SHEET

This invention relates generally to an electrophotographic printing machine and more particularly concerns an apparatus for drying and fusing a liquid image to a copy sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration, on the photoconductive member. Thereafter, the developed image is transferred to the copy sheet. Invariably, some of the liquid carrier is transferred along with the pigmented particles to the copy sheet. After transfer, heat is applied to the copy sheet to permanently fuse the pigmented particles and vaporize the residual liquid carrier.

Numerous techniques have been developed for heating the developed image on the copy sheet to permanently fuse the pigmented particles thereto. Among these are oven fusing, hot air fusing, flash fusing and roll fusing. In general, these techniques have been particularly useful in permanently fusing dry powder image to the copy sheet. However, these techniques do not appear to be optimal for permanently fusing the pigmented particles and vaporizing the residual liquid carrier when a liquid development system is employed in the printing machine. It has been found that when radiant, flash, hot air, and oven techniques are employed to fuse pigmented particles and vaporize the liquid carrier, micro-voids frequently occur. This defect is believed to be caused by the tendency of the pigmented particles to accumulate in groups leaving visible gaps and exposing the copy sheet substrate. Thus, it is highly desirable to both fuse the pigmented particles and vaporize the residual liquid carrier adhering to the copy sheet without forming micro-voids. Hereinbefore, various techniques have been devised for improving fusing of both dry powder images and liquid images. The following disclosures appear to be relevant:

U.S. Pat. No. 3,079,483 Patentee: Codichini et al. Issued: Feb. 26, 1963

U.S. Pat. No. 3,465,203 Patentee: Galster et al. Issued: Sept. 2, 1969

U.S. Pat. No. 3,566,076 Patentee: Fantuzzo et al. Issued: Feb. 23, 1971

U.S. Pat. No. 4,423,956 Patentee: Gordon Issued: Jan. 3, 1984

The relevant portions of the foregoing patents may be briefly summarized as follows:

Codichini et al. discloses a radiant fuser for permanently fusing dry toner particles to a copy sheet. The fuser includes a bottom radiant heating panel and a top radiant heating panel. Each radiant heating panel includes a coiled nickel chromium resistor wire compacted in a dielectric material which is enclosed by a metal sheet. The tubular heating elements and panel are connected to each other by an end conductor. The radiant heating panels are connected to a power source and controlled by a thermostat to regulate the amount of electrical energy being furnished to the panel and to control the energy being furnished to the copy sheet to permanently affix the dry toner particles thereto.

Galster et al. discloses a xenon flash lamp used in a fuser of an electrophotographic printing machine for permanently affixing a toner powder image to a copy sheet.

Fantuzzo et al. discloses a fusing station employing a cold roll fixer to partially fix the dry toner powder image to the copy sheet. A radiant energy source following the cold roll fixer furnishes sufficient energy to complete the fusing operation.

Gordon discloses a contact printing apparatus wherein an image bearing web is positioned in close contact with a photosensitive web. The photosensitive web is developed with a liquid developer material. The photosensitive web passes through a drier which may an air knife or a fan designed to blow cool air across the surface of the film. Once the image has been dried on the surface of the photoconductive surface, heat is added thereto to melt or fuse the toner particles together to form a permanent image. Heat may be added for fusing by fusing rollers, a quartz infrared lamp, air heated coils, or infrared radiation.

In accordance with one aspect of the present invention, there is provided a reproducing machine of the type having a latent image recorded on a member. Means are provided for developing the latent image recorded on the member with a liquid developer material comprising at least a liquid carrier having pigmented particles dispersed therein. Means transfer the developed image from the member to a sheet of support material. Means apply at least heat to the sheet of support material having the developed image thereon to substantially dry the sheet of support material and remove substantially all of the liquid carrier transferred thereto. Means generate at least heat to fuse the pigmented particles, in image configuration, to the sheet of support material Pursuant to another aspect of the features of the present invention, there is provided an electrophotographic printing machine wherein an electrostatic latent image is recorded on a photoconductive member. Means develop the electrostatic latent image recorded on the photoconductive member with a liquid developer material comprising at least a liquid carrier having pigmented particles dispersed therein. Means transfer the developed image from the photoconductive member to a sheet of support material. Means apply at least heat to the sheet of support material having the developed image thereon to substantially dry the sheet of support material and remove substantially all of the liquid carrier transferred thereto. Means generate at least heat to fuse the pigmented particles, in image configuration, to the sheet of support material after substantially all of the liquid carrier has been removed therefrom.

Still another aspect of the present invention, is a method of electrophotographic printer including the steps of recording an electrostatic latent image on a photoconductive member. The electrostatic latent image recorded on the photoconductive member is developed with a liquid developer material comprising at least a liquid carrier having pigmented particles dispersed therein. The developed image is transferred from the photoconductive member to a sheet of support material. At least heat is applied to the sheet of support material having the developed image thereon to dry the sheet of support material and remove substantially all of the liquid carrier transferred therefrom. Thereafter, heat is generated to fuse the pigmented particles, in image configuration, to the sheet of support material.

Other aspects of the present invention will become apparent as the following description proceeds and upon reference to the drawings, in which.

While the present invention will hereinafter be described in conjunction with various embodiment and methods of use, it will be understood that it is not intended to limit the invention to these embodiments or methods of use. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
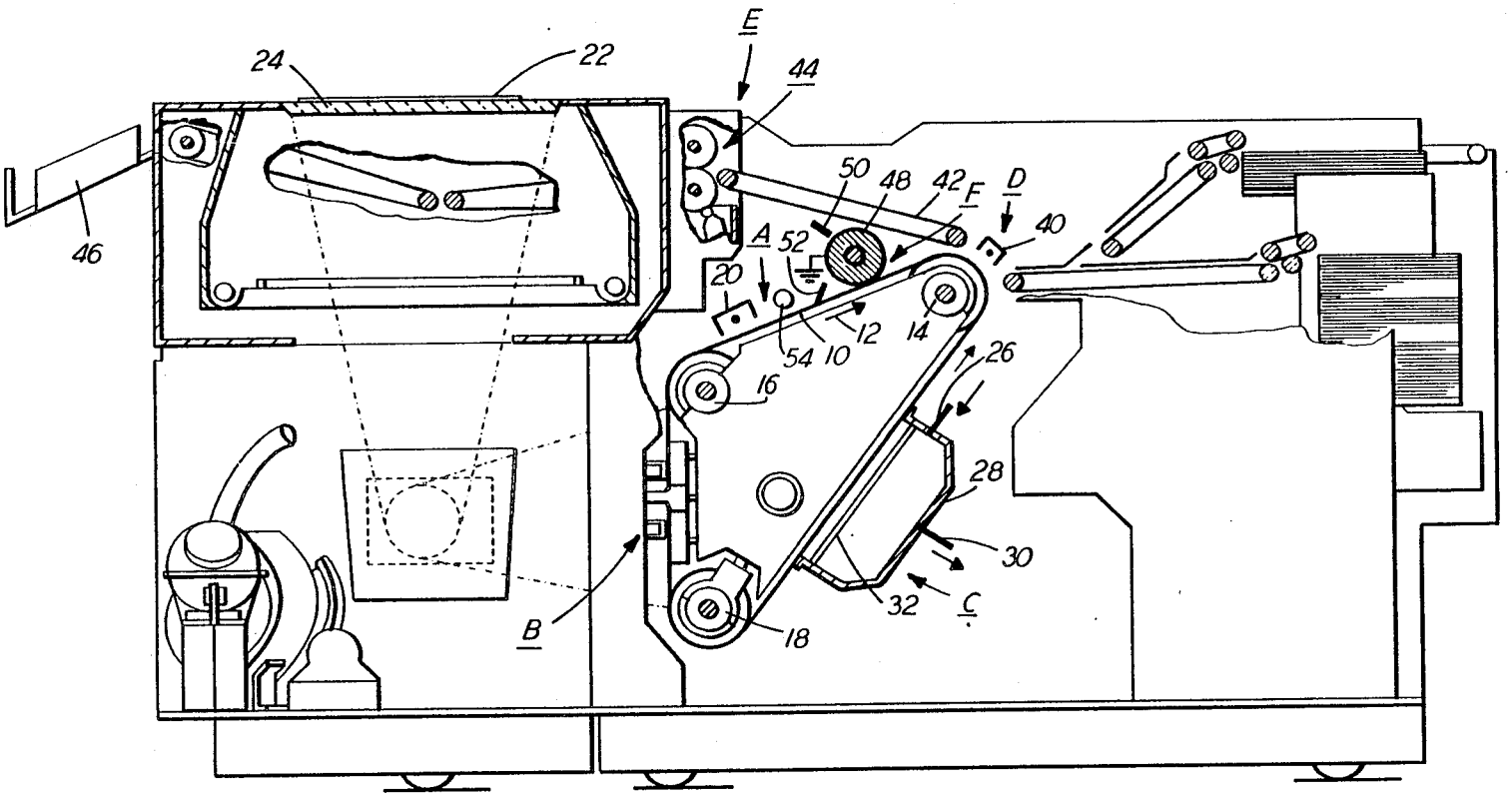
FIG. 1 is a schematic elevational view showing an illustrative photographic printing machine incorporating the features of the present invention.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and photoconductive substrates may also be employed. Belt 10 moves in the direction of arrow 12 to advance successive portions of the photoconductive surface through the various processing stations disposed about the path of movement thereof. The photoconductive belt is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image corresponding to the informational areas contained within the original document on the photoconductive surface. Thereafter, belt 10 advances the electrostatic latent image recorded on the photoconductive surface to development station C.

At development station C, a developing liquid, comprising an insulating carrier liquid and toner particles, is circulated from any suitable source (not shown) through pipe 26 into a development tray 28 from which it is drawn through pipe 30 for recirculation. Development electrodes 32, which may be appropriately electrically biased, assist in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide, the photoconductive surface charge will be negative and the toner particles will be positively charged. Generally, the amount of liquid carrier on the photoconductive surface is too great. A roller (not shown), whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Figure 2:
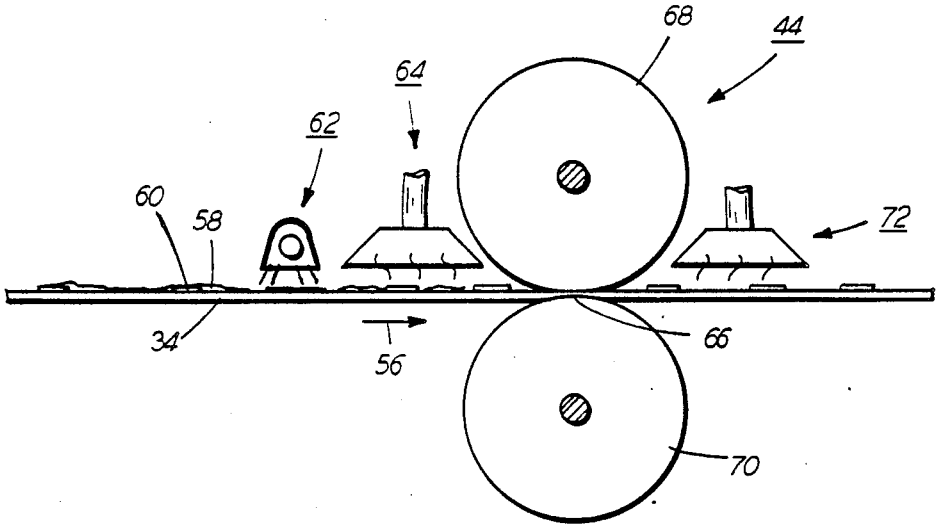
FIG. 2 is an elevational view depicting one embodiment of the fusing apparatus used in the FIG. 1 printing machine.
Figure 3:
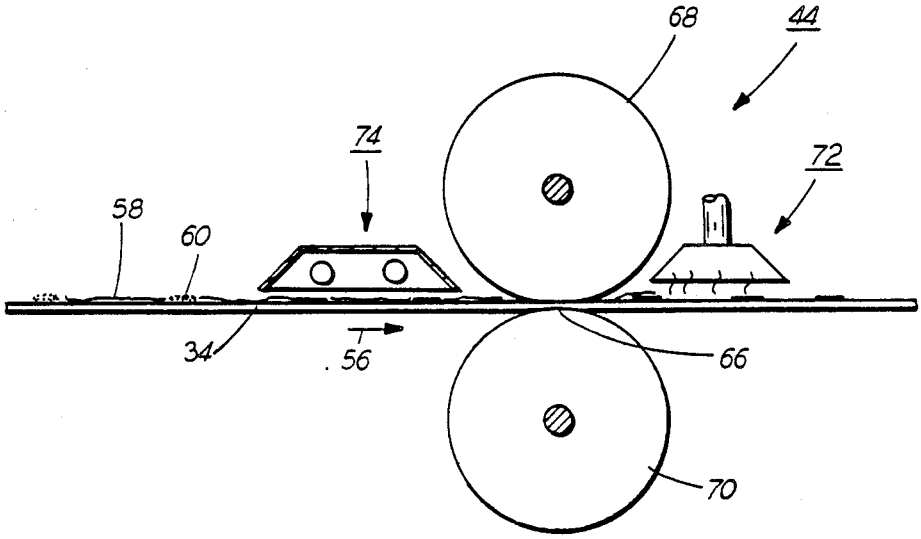
FIG. 3 is another embodiment of the fusing apparatus used in the FIG. 1 printing machine.

Fusing station E includes a fuser assembly, indicated generally by the reference numeral 44, which dries the copy sheet and permanently fuses the toner particles in image configuration thereto. The detailed structure of fuser assembly 44 will be described with reference to two embodiments thereof, as shown in FIGS. 2 and 3. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F. includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles, dispersed therein. A suitable insulating liquid carrier may be made from a low boiling aliphatic hydrocarbon, such as an isopar, which is a trademark of the Exxon Corporation. The toner particles include a pigment, such as carbon black, associated with a polymer. A suitable liquid developer material is described in Copending U.S. patent application Ser. No. 679,906, filed Dec. 11, 1984, the relevant portions thereof being hereby incorporated into the present application.

It is believe that the foregoing description is sufficient for purposes of the present application to illustrate the general operation of an electrophotographic printing machine incorporating the features of the present invention therein.

Referring now to FIG. 2, there is shown one embodiment of fuser assembly 44 in greater detail. As depicted thereat, copy sheet 34 moves in the direction of arrow 56 with both some residual liquid carrier 58 and pigmented particles 60 deposited thereon. A radiant heater, indicated generally by the reference numeral 62, generates radiant energy in the infrared wave length which is selectively absorbed by the developed image areas on the copy sheet. This will cause the liquid carrier 58 in the developed image to vaporize and the pigmented particles 60 to melt, decreasing their viscosity. Radiant heater 62 includes an infrared quartz lamp which is mounted in a reflector assembly in an opposing relationship to the copy sheet and in a position to thermally communicate with the image side thereof. However, one skilled in the art will appreciate that any suitable radiant heater may be employed to preheat the developed image as heretofore described. Furthermore, one skilled in the art will appreciate that an oven heater may be employed in lieu of a radiant heater to preheat the developed image and vaporize the liquid carrier from the copy sheet.

After the developed image is preheated, either by radiant or oven heating, the copy sheet advances through an exhaust system, indicated generally by the reference numeral 64, which comprises a blower for sucking the vaporized liquid carrier material away from the copy sheet.

The copy sheet then advances into the nip 66 defined by fuser roller 68 and back-up pressure roller 70. Roller 70 and roller 68 are resiliently urged into engagement with one another to define nip 66. Back-up roll 70 includes a rigid internal core, which may be steel, over which a sleeve-like cover of flexible material having non-stick properties, such as Teflon, is mounted. Fuser roller 68 similarly has a rigid internal core which may be steel, having a relatively thick sleeve-like covering thereover. The fuser roll sleeve is comprised of a flexible material, such as silicone rubber. To heat fuser roller 68, a lamp is disposed within the fuser roller core. The core has a suitable opening for receipt of the lamp. In this arrangement, heat energy from the lamp permeates through the metal core and outer sleeve to heat the surface of fuser roller 68 to the requisite temperature required to fuse the pigmented particles on copy sheet 34. Any remaining liquid carrier material is vaporized at this time. In addition, fusing of the pigmented particles is completed under slight pressure. This results in improved image quality by reducing the micro-voids which occur during fusing. As previously noted, this defect is caused by the tendency of the image particles to accumulate in groups leaving visible gaps between them exposing the substrate of the copy sheet. The pressure and conformability of the roll fusing system can be adjusted to minimize the production of micro-voids on the copy sheet. To enhance the heating efficiency of fusing system 44 and to reduce any tendency of the pigmented particles to stick to fuser roller 68, a suitable release material or agent is applied to the surface of fuser roller 68. While the release material may comprise any suitable liquid, a preferred material is silicone oil. After the copy sheet passes through nip 66 defined by fuser roller 68 and pressure roller 70, it passes beneath exhaust system, indicated generally by the reference numeral 72. Exhaust system 72 is substantially identical to exhaust system 64 and includes a blower system to remove any vaporized liquid carrier from the vicinity of copy sheet 34. In this way, the liquid developed image is initially dried by radiant heater 62 and, thereafter, permanently fused to the copy sheet by fuser roller 68 and pressure roller 70, resiliently urged by a spring system (not shown) into pressing engagement with one another. A system of this type significantly improves the fused image by substantially eliminating micro-voids therein.

Another embodiment of the present invention is shown in FIG. 3. Turning now to FIG. 3, fuser assembly 44 includes a flash fuser indicated generally by the reference numeral 74. As copy sheet 34 moves in the direction of arrow 56, the liquid carrier 58 and unfused pigmented particles deposited thereon pass beneath fuser 74. Flash fuser 74 emits radiant energy which is selectively absorbed by the image areas on copy sheet 34. This causes pigmented particles 60 to instantly fuse to copy sheet 34 in image configuration. Preferably, the radiant energy is emitted in a 0.5 to 15 millisecond flash. Flash fuser 74 includes a plurality of flash lamps. Each flash lamp may comprise a quartz tube filled with a suitable gas, for example, Xenon gas, and contains two electrodes, one sealed at each end thereof. The flash lamps provide a pulse for fusing the toner particles deposited on the copy sheet thereto. A suitable flash fuser is described in U.S. Pat. No. 3,465,203 issued to Galster et a. in 1969, the relevant portions thereof being hereby incorporated into the present application. After passing beneath flash fuser 74, the copy sheet enters into the nip 66 defined by fuser roller 68 and pressure roller 70. At this time, heat is transferred to the surface of the copy sheet vaporizing the excessive liquid carried adhering thereto. Thus, fuser roller 68 and pressure roller 70 act as a dryer. In addition, the toner particle image is reheated under slight pressure in nip 66. This results in improved image quality by introducing a slight amount of flow reducing the micro-voids which occur during the flash fusing step. The pressure and temperature of fuser roller 68 and pressure roller 70 can be adjusted to minimize the production of micro-voids in the images as well as produce the required level of carrier removal. Both pressure roller 70 and fuser roller 68 have heretofore been described with respect to FIG. 2. After passing through the nip 66, the copy sheet passes beneath exhaust system 72 which includes a blower to remove the vaporized liquid carrier from the vicinity of copy sheet 34.

In recapitulation, it is clear that the fusing apparatus of the present invention dries the copy sheet and permanently fuses the pigmented particles thereto in image configuration while minimizing the formation of micro-voids. In one embodiment, drying is achieved by applying radiant or oven preheat to the liquid developed image on the copy sheet and subsequently passing the copy sheet through the nip defined by a heated fuser roll and back-up pressure roll to permanently fuser the toner particles thereto in image configuration. In another embodiment, the liquid developer material passes beneath a flash fuser which emits radiant energy to fuse the toner particles to the copy sheet in image configuration. Thereafter, the copy sheet passes through a nip defined by a heated fuser roller and pressure roller to dry the copy sheet removing the excessive liquid carrier adhering thereto. In either case, the application of pressure to the partially melted particles significantly reduces the micro-voids in the resultant copy.

It is, therefore, evident that there has been provided in accordance with the present invention, a fushing apparatus that fully satisfies the aims and advantages heretofore mentioned. While this invention has been described in conjunction with various embodiments and methods of use thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A reproducing machine of the type having a latent large recorded on a member, wherein the improvement includes:

means for developing the latent image recorded on the member with a liquid developer material comprising at least a liquid carrier having pigmented particles dispersed therein;

means for transferring the developed image from the member to a sheet of support material;

a flash fuser arranged to radiate sufficient energy onto the developed image to permanently fuse the pigmented particles to the sheet of support material in image configuration;

a pressure roll; and a heated roll cooperating with said pressure roll to form a nip through which the sheet of support material having the developed image thereon passes after said flash fuser has permanently fused the pigmented particles to the sheet of support material so as to vaporize substantially all of the liquid carrier transferred to the sheet of support material and to reheat the pigmented particles as the sheet of support material passes through the nip.

2. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed image from the member to a sheet of support material;

a radiant heater arranged to radiate sufficient energy onto the sheet of support material to vaporize substantially all of the liquid carrier transferred to the sheet of support material and to partially melt the pigmented particles on the sheet of support material;

a pressure roll; and a heated fuser roll cooperating with said pressure roll to form a nip through which the sheet of support material having the developed image thereon passes after said radiant heater has vaporized substantially all of the liquid carrier therefrom and the pigmented particles have been partially melted so as to apply heat and pressure to the developed image to permanently fuse the pigmented particles to the sheet of support material and vaporize remaining liquid carrier therefrom as the sheet of support material passes through the nip.

3. A reproducing machine of the type having a latent image recorded on a member, wherein the improvement includes:

means for developing the latent image recorded on the member with a liquid developer material comprising at least a liquid carrier having pigmented particles dispersed therein;

means for transferring the developed image from the member to a sheet of support material;

an oven heater arranged to apply sufficient heat to the sheet of support material to vaporize substantially all of the liquid carrier transferred to the sheet of support material and to partially melt the pigmented particles on the sheet of support material;

a pressure roll; and a heated fuser roll cooperating with said pressure roll to form a nip through which the sheet of support material having the developed image thereon passes after said oven heater has vaporized substantially all of the liquid carrier therefrom and the pigmented particles have been partially melted so as to apply heat and pressure to the developed image to permanently fuse the pigmented particles to the sheet of support material and vaporize remaining liquid carrier therefrom as the sheet of support material passes through the nip.

4. A method of electrophotographic printing, including the steps of:

recording an electrostatic latent image on a photoconductive member;

developing the electrostatic latent image recorded on the photoconductive member with a liquid developer material comprising at least a liquid carrier having pigmented particles dispersed therein;

transferring the developed image from the photoconductive member to a sheet of support material;

flash fusing the developed image to radiant sufficient energy onto the developed image to permanently fuse the pigmented particles to the sheet of support material in image configuration; and moving the sheet of support material with the developed image thereon through a nip defined by a pressure roll pressing against a heated roll after said step of flash fusing so as to vaporize substantially all of the liquid carrier transferred to the sheet of support material and partially melting the pigmented particles as the sheet of support material passes through the nip.

5. A method of electrophotographic printing, including the steps of:

recording an electrostatic latent image on a photoconductive member;

developing the electrostatic latent image recorded on the photoconductive member with a liquid developer material comprising at least a liquid carrier having pigmented particles dispersed therein;

transferring the developed image from the photoconductive member to a sheet of support material;

radiating sufficient energy onto the sheet of support material to vaporize substantially all of the liquid carrier transferred to the sheet of support material and partially melting the pigmented particles thereon; and moving the sheet of support material with the developed image thereon through a nip defined by a pressure roll pressing against a heated roll after said step of radiating so as to vaporize substantially all of the liquid carrier transferred to the sheet of support material and partially melting the pigmented particles as the sheet of support material passes through the nip.

* * * * *